US009197961B2

(12) United States Patent
Chang et al.

(10) Patent No.: US 9,197,961 B2
(45) Date of Patent: Nov. 24, 2015

(54) PORTABLE ELECTRONIC DEVICE WITH INTERNAL SPEAKER

(75) Inventors: Chia-Ming Chang, Taoyuan County (TW); Chia-Yan Hsu, Taoyuan County (TW); Hsin-Chien Peng, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 278 days.

(21) Appl. No.: 13/615,665

(22) Filed: Sep. 14, 2012

(65) Prior Publication Data

US 2014/0079263 A1 Mar. 20, 2014

(51) Int. Cl.
*H04R 1/02* (2006.01)
*H04R 1/28* (2006.01)

(52) U.S. Cl.
CPC ..... *H04R 1/2803* (2013.01); *H04R 2499/11* (2013.01)

(58) Field of Classification Search
CPC ..... H04R 1/2803
See application file for complete search history.

(56) References Cited

U.S. PATENT DOCUMENTS 5,821,471 A * 10/1998 McCuller ..... 181/156
8,494,577 B2 * 7/2013 Shiogama ..... H04M 1/035 455/550.1
2002/0121403 A1 * 9/2002 Sahyoun ..... 181/157
2003/0003879 A1 * 1/2003 Saiki et al. ..... 455/90
2004/0037441 A1 * 2/2004 Konishi et al. ..... 381/190
2005/0233781 A1 * 10/2005 Erixon et al. ..... 455/575.1
2007/0195982 A1 * 8/2007 Saiki et al. ..... 381/345
2008/0025547 A1 * 1/2008 Yun et al. ..... 381/389
2008/0170736 A1 * 7/2008 Yu et al. ..... 381/345
2009/0114557 A1 * 5/2009 Nelson ..... 206/320
2009/0226207 A1 * 9/2009 Matsushita ..... 399/105
2010/0061584 A1 * 3/2010 Lin et al. ..... 381/386
2011/0235847 A1 * 9/2011 Bhutani et al. ..... 381/395
2012/0106766 A1 * 5/2012 Kuroda ..... 381/337
2012/0155695 A1 * 6/2012 Park ..... 381/396

* cited by examiner

*Primary Examiner* — Wayne Young
*Assistant Examiner* — Mark Fischer
(74) *Attorney, Agent, or Firm* — Jianq Chyun IP Office

(57) ABSTRACT

A portable electronic device including a circuit board, a speaker, an electronic component and an inner casing is provided. The speaker is disposed on the circuit board. The electronic component is disposed on the circuit board and right next to the speaker. The circuit board is disposed in the inner casing including a main cavity, an extended cavity and a channel. The main cavity is connected to the circuit board to define an acoustic chamber for containing the speaker. The main cavity having a first opening. The speaker is connected to the first opening and a part of the speaker is exposed by the first opening. The extended cavity is connected to the main cavity and located above the electronic component. The channel connects the main cavity and the extended cavity, and the extended cavity communicates with the main cavity through the channel.

13 Claims, 3 Drawing Sheets

PORTABLE ELECTRONIC DEVICE WITH INTERNAL SPEAKER

BACKGROUND OF THE DISCLOSURE

1. Field of the Disclosure

The disclosure generally relates to an electronic device. More particularly, the disclosure relates to a portable electronic device.

2. Description of Related Art

In the modern information era, people are becoming more and more dependent on portable electronic device such as mobile phones, laptop, tablet PC and handheld game consoles that are commonly seen in people's daily lives. Take mobile phones for example, various manufacturers devote research effort to minimizing weight and dimensions of mobile phones so as to provide users with portability.

However, reducing the dimensions of an existing mobile phone involves a close matching of all the elements within the mobile phone including the location and size of a sound box for housing an acoustic chamber. In fact, quality of sound emitted from the phone largely depends on the size of the sound box. In general, a larger sound box can obtain a better sound quality. Nevertheless, when the mobile phone is reduced in size, the sound box within the phone must be reduced correspondingly. As a result, the low frequency response of the speaker will deteriorate. Hence, how to utilize limited space to maximize sound quality is an important topic for manufacturers of portable electronic devices nowadays.

SUMMARY OF THE DISCLOSURE

Accordingly, the disclosure is directed to a portable electronic device which improves the sound quality without increasing the size of the portable electronic device.

The disclosure provides a portable electronic device including a circuit board, a speaker, an electronic component and an inner casing. The speaker is disposed on the circuit board. The electronic component is disposed on the circuit board and right next to the speaker. The circuit board is disposed in the inner casing, and the inner casing includes a main cavity, an extended cavity and a channel. The main cavity is connected to the circuit board to define an acoustic chamber for containing the speaker. The main cavity has a first opening, wherein the speaker is connected to the first opening and a part of the speaker is exposed by the first opening. The extended cavity is connected to the main cavity and located above the electronic component. The extended cavity has a second opening facing opposite to the circuit board and a chamber cover sealing the second opening. The chamber cover and the extended cavity define an extended chamber. The channel connects the main cavity and the extended cavity, and the extended cavity communicates with the main cavity through the channel.

Based on the above, the disclosure utilizes the spare space above the electronic component next to the speaker to form an extended cavity as the extended chamber for the speaker, wherein the extended cavity communicates with the main cavity containing the speaker through a channel. Thus, the total volume of the chambers for the speaker can be increased so as to improve the sound quality of the speaker of the portable electronic device. Also, with the disposition of the sound proof components, the sound generated by the speaker can be transmitted between the acoustic chamber and the extended chamber without sound leakage, thus sound quality is further promoted. Therefore, the disclosure maximizes the sound quality of the portable electronic device without increasing the size thereof.

In order to make the aforementioned features and advantages of the disclosure more comprehensible, embodiments accompanying figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
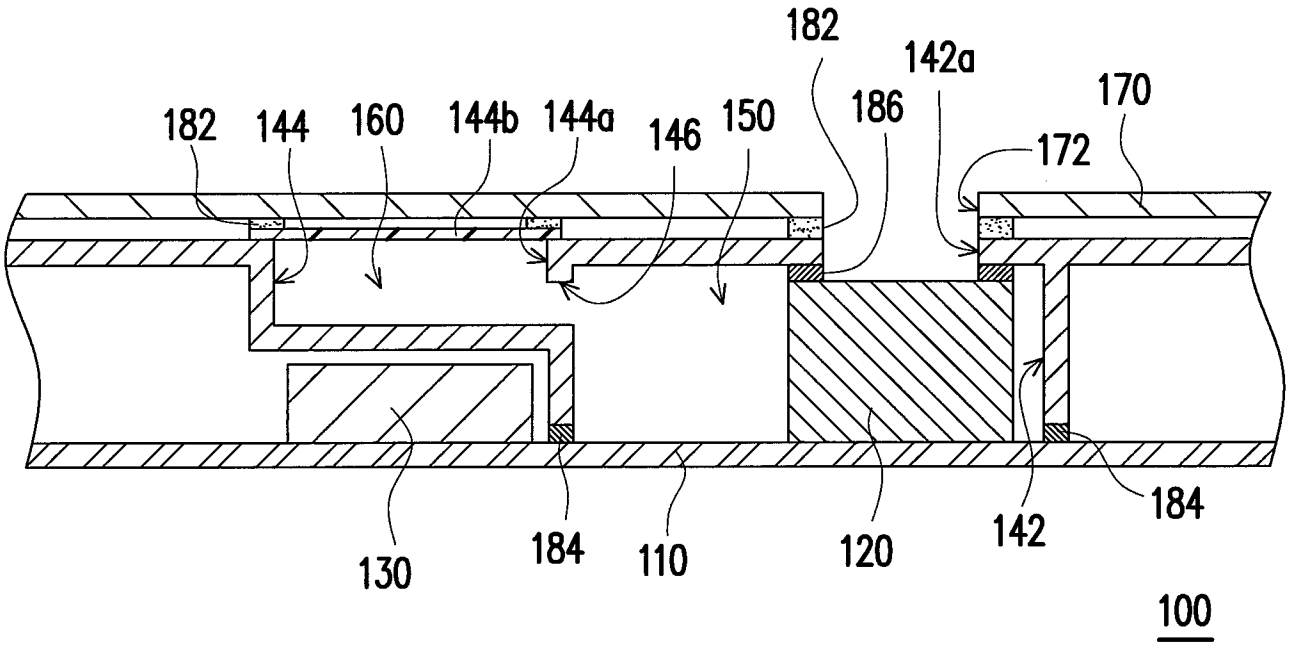
FIG. 1 illustrates a local cross-sectional view of a portable electronic device according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 2:
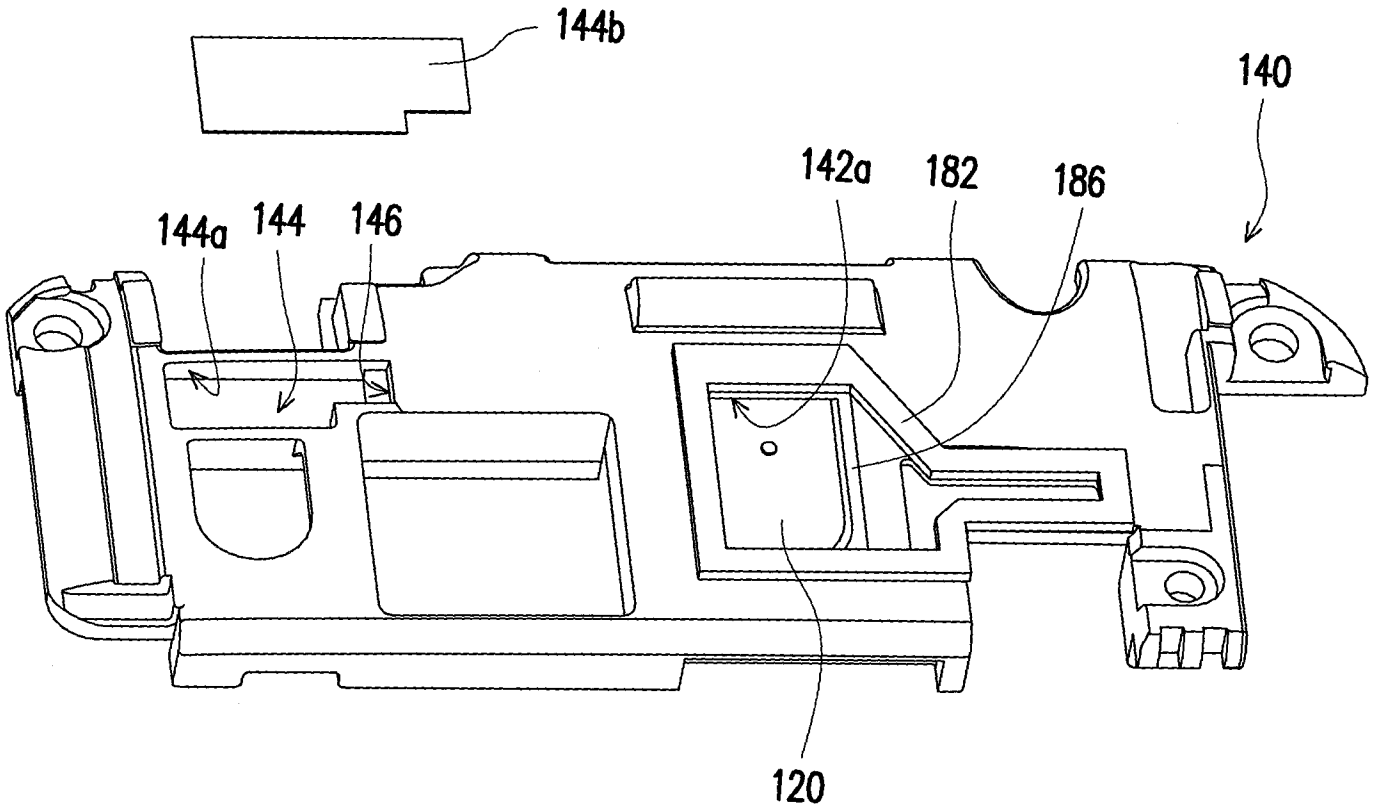
FIG. 2 illustrates the top perspective view of the inner casing of FIG. 1.
Figure 3:
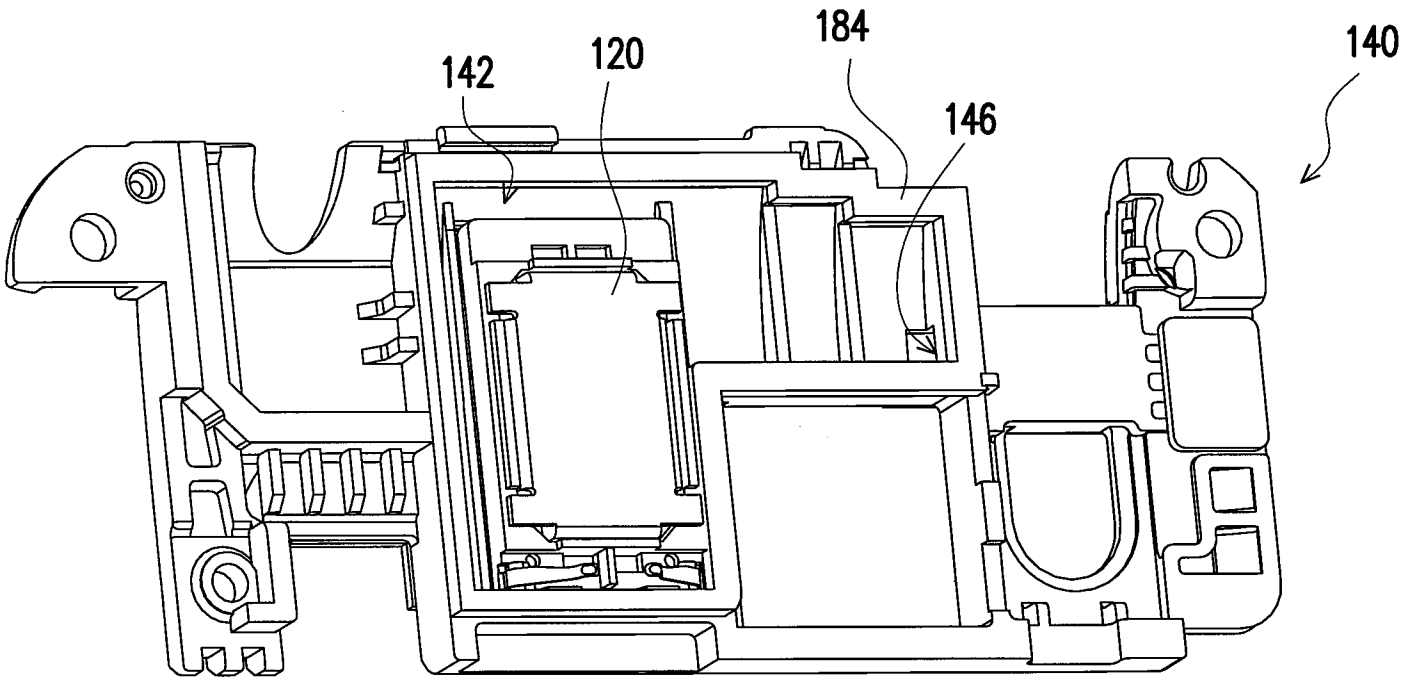
FIG. 3 illustrates the bottom perspective view of the inner casing of FIG. 1.

FIG. 1 illustrates a local cross-sectional view of a portable electronic device according to an embodiment of the disclosure. FIG. 2 illustrates the top perspective view of the inner casing of FIG. 1. FIG. 3 illustrates the bottom perspective view of the inner casing of FIG. 1. Referring to FIG. 1 to FIG. 3, the portable electronic device 100 of the present embodiment includes a circuit board 110, a speaker 120, an electronic component 130 and an inner casing 140. In the present embodiment, the portable electronic device 100 is, for example, but not limited to, a mobile phone, and those of ordinary skills in the art can apply the disclosure to other portable electronic devices such as laptop, tablet PC, etc. depending upon the actual requirements. The speaker 120 is disposed on the circuit board 110. The circuit board 110 is disposed in the inner casing 140, and the inner casing 140 includes a main cavity 142, an extended cavity 144 and a channel 146. In the present embodiment, the inner casing 140 is a molding injection element, in other words, the inner casing 140 is made by molding injection technique, and can be integrally formed. The main cavity 142 has a first opening 142*a*, wherein the speaker 120 is connected to the first opening 142*a* and a part of the speaker 120 is exposed by the first opening 142*a*. The electronic component 130 is disposed on the circuit board 110 and located right next to the speaker 120. The extended cavity 144 has a second opening 144*a* facing opposite to the circuit board 110, and a chamber cover 144*b* sealing the second opening 144*a*. In the present embodiment, the material of the chamber cover 144*b* is, for example, a polyester film (a trade name: MYLAR®) and the chamber cover 144*b* is adhere to the extended cavity 144 to seal the second opening 144*a*. The disclosure does not limit the material of the chamber cover 144*b* and how the chamber cover 144*b* attach to the extended cavity 144 to seal the second opening 144*a*.

The main cavity 142 is connected to the circuit board 110 to define an acoustic chamber 150, as shown in FIG. 2, for containing the speaker 120. The chamber cover 144*b* and the extended cavity 144 together define an extended chamber 160. The extended cavity 144 is connected to the main cavity 142 and located above the electronic component 130. The channel 146 connects the main cavity 142 and the extended cavity 144, and the extended cavity 144 communicates with the main cavity 142 through the channel 146. In the present embodiment, the portable electronic device 100 further includes an outer casing 170, as shown in FIG. 2, covering the inner casing 140. The outer casing 170 has a sound hole 172 corresponding to the first opening 142*a* as shown in FIG. 2. The main cavity 142 and the extended cavity 144 are located between the outer casing 170 and the circuit board 110, and the extended cavity 144 is located between the outer casing 170 and the electronic component 130.

With the layout proposed above, the present embodiment of the disclosure utilizes the spare space above the electronic component 130 next to the speaker 120 as an extended cavity 144, such that the total volume of the chamber for the speaker 120 can be increased by connecting the main cavity 142 to the extended cavity 144 through the channel 146, so as to improve the sound quality of the speaker 120 without taking up any extra space of the portable electronic device 100 which means the size of the chamber for the speaker 120 can be expanded without increasing the size of the portable electronic device 100.

In the present embodiment, the portable electronic device 100 further includes a plurality of sound proof components 182, 184 and 186. The material of the sound proof components 182, 184 and 186 includes sponge, but the disclosure is not limited thereto. The sound proof component 182 is disposed between the inner casing 140 and the outer casing 170. To be more specific, the sound proof component 182 surrounds the edge of the first opening 142*a* and the edge of the second opening 144*a* and leaning between the inner casing 140 and the outer casing 170 as shown in FIG. 1 and FIG. 2. The sound proof component 184 leans between the main cavity 142 and the circuit board 110 as shown in FIG. 2 and FIG. 3. The sound proof component 186 leans between the speaker 120 and the edge of the first opening 142*a* of the main cavity 142 as shown in FIG. 1 and FIG. 2. With the disposition of the sound proof components 182, 184 and 186, the sound leakage of the acoustic chamber 150 and the extended chamber 160 can be avoided such that the sound quality of the portable electronic device 100 can be further improved.

According to the above descriptions, the disclosure utilizes the spare space above the electronic component next to the speaker to form an extended cavity as the extended chamber for the speaker, wherein the extended cavity communicates with the main cavity containing the speaker through a channel. Thus, the total volume of the chamber for the speaker can be increased so as to improve the sound quality of the speaker of the portable electronic device. Also, with the disposition of the sound proof components, the sound generated by the speaker can be transmitted between the acoustic chamber and the extended chamber without sound leakage thus sound quality is further promoted. Therefore, the disclosure can maximize the sound quality without increasing the size of the portable electronic device.

It will be apparent to those skilled in the art that various modifications and variations can be made to the structure of the disclosure without departing from the scope or spirit of the disclosure. In view of the foregoing, it is intended that the disclosure cover modifications and variations of this invention provided they fall within the scope of the following claims and their equivalents.

What is claimed is:

1. A portable electronic device, comprising:

an outer casing;

a circuit board, disposed in the outer casing;

a speaker, disposed on the circuit board and in the outer casing;

an electronic component, disposed on the circuit board and right next to the speaker; and an inner casing, disposed in the outer casing, having a first side facing toward the circuit board and a second side facing away from the circuit board, wherein the first side and the second side are two opposite sides of the inner casing, the circuit board disposed in the inner casing, and the inner casing comprising:

a main cavity, formed between the first side and the circuit board, defining an acoustic chamber with the speaker, the speaker disposed on the circuit board in the main cavity, the inner casing having a first opening coupled to the main cavity, wherein the speaker is coupled to the first opening and a part of the speaker is exposed by the first opening;

an extended cavity, formed by the second side, located above the electronic component, the inner casing having a second opening coupled to the extended cavity and a chamber cover disposed between the second side of the inner casing and the outer casing, sealing the second opening, the chamber cover and the second side forming the extended cavity define an extended chamber located above the electronic component, wherein the first opening communicates with an opening in the outer casing, and the chamber cover does not communicate with an opening in the outer casing; and a channel, connecting the acoustic chamber and the extended chamber, the acoustic chamber, the extended chamber and the channel forming a sound box for the speaker.

2. The portable electronic device as claimed in claim 1, wherein the outer casing having a sound hole corresponding to the first opening.

3. The portable electronic device as claimed in claim 2, wherein the main cavity and the extended cavity are located between the outer casing and the circuit board.

4. The portable electronic device as claimed in claim 2, wherein the extended cavity is located between the outer casing and the electronic component.

5. The portable electronic device as claimed in claim 2 further comprising:

a sound proof component, disposed between the inner casing and the outer casing.

6. The portable electronic device as claimed in claim 5, wherein the sound proof component surrounds the edge of the first opening and the edge of the second opening and leaning between the inner casing and the outer casing.

7. The portable electronic device as claimed in claim 5, wherein the sound proof component includes sponge.

8. The portable electronic device as claimed in claim 1 further comprising:

a sound proof component, leaning between the main cavity and the circuit board.

9. The portable electronic device as claimed in claim 8, wherein the sound proof component includes sponge.

10. The portable electronic device as claimed in claim 1 further comprising:

a sound proof component, leaning between the speaker and the edge of the first opening of the main cavity.

11. The portable electronic device as claimed in claim 10, wherein the sound proof component includes sponge.

12. The portable electronic device as claimed in claim 1, wherein the material of the chamber cover includes a polyester film, sold under the trademark MYLAR®.

13. The portable electronic device as claimed in claim 1, wherein the inner casing is a molding injection element.

* * * * *